US011885540B2

(12) United States Patent
Rahhal

(10) Patent No.: US 11,885,540 B2
(45) Date of Patent: Jan. 30, 2024

(54) CONDENSERS FOR HEATING AND/OR COOLING SYSTEMS

(71) Applicant: Carrier Corporation, Palm Beach Gardens, FL (US)

(72) Inventor: Charbel Rahhal, Lyons (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 93 days.

(21) Appl. No.: 17/539,318

(22) Filed: Dec. 1, 2021

(65) Prior Publication Data

US 2022/0178596 A1 Jun. 9, 2022

(30) Foreign Application Priority Data

Dec. 4, 2020 (EP) ..... 20212051

(51) Int. Cl.
*F25B 39/04* (2006.01)
*F25B 40/02* (2006.01)
(Continued)

(52) U.S. Cl.
CPC ..... *F25B 39/04* (2013.01); *F25B 1/10* (2013.01); *F25B 40/02* (2013.01); *F25B 41/31* (2021.01);
(Continued)

(58) Field of Classification Search
CPC .. F25B 41/31; F25B 49/02; F25B 1/10; F25B 2339/044; F25B 2339/0444;
(Continued)

(56) References Cited

U.S. PATENT DOCUMENTS 2,888,809 A * 6/1959 Rachfal ..... F25B 1/053 62/196.3
3,022,638 A * 2/1962 Caswell ..... F25B 1/053 62/505
(Continued)

FOREIGN PATENT DOCUMENTS

DE 10060114 A1 * 6/2001 ..... B60H 1/3227
DE 112015004059 T5 5/2017
(Continued)

OTHER PUBLICATIONS

English translation of Haussmann et al. (DE 10060114 A1) (Year: 2001).*
(Continued)

*Primary Examiner* — Miguel A Diaz
(74) *Attorney, Agent, or Firm* — CANTOR COLBURN LLP

(57) ABSTRACT

A method of cooling a refrigerant includes providing a condenser (200) including a condenser shell (202) that contains a condenser chamber (204), a condensing conduit (209), and a cooling conduit (217); condensing a refrigerant within the condenser chamber (204) from a vapour phase to a liquid phase by exchanging heat from the refrigerant in the condenser chamber (204) to a fluid in the condensing conduit (209); supplying a first portion of the condensed refrigerant to the cooling conduit (217) via a first expansion valve (310) such that the first portion of the refrigerant decreases in pressure and temperature before entering the cooling conduit (217); and cooling the refrigerant in the condenser chamber (204) by exchanging heat from the refrigerant in the condenser chamber (204) to the first portion of the refrigerant in the cooling conduit (217).

15 Claims, 4 Drawing Sheets

(51) Int. Cl.
*F25B 41/31* (2021.01)
*F25B 1/10* (2006.01)
*F25B 49/02* (2006.01)

(52) U.S. Cl.
CPC ..... *F25B 49/02* (2013.01); *F25B 2339/047* (2013.01); *F25B 2400/0411* (2013.01); *F25B 2400/0417* (2013.01); *F25B 2400/13* (2013.01)

(58) Field of Classification Search
CPC ..... F25B 2339/047; F25B 2400/04; F25B 2400/0409; F25B 2400/0411; F25B 2400/0417; F25B 2400/13; F25B 2600/2509
See application file for complete search history.

(56) References Cited

U.S. PATENT DOCUMENTS 9,134,057 B2 * 9/2015 Iijima ..... F25B 40/00
10,254,014 B2 * 4/2019 Miyoshi ..... F25B 41/39
2009/0113900 A1 * 5/2009 Lifson ..... C09K 5/045 62/77
2013/0298596 A1 * 11/2013 Iijima ..... F25B 39/04 62/498
2017/0254568 A1 * 9/2017 Miyoshi ..... F25B 1/10
2023/0053834 A1 * 2/2023 Mitra ..... F25B 31/006
2023/0056774 A1 * 2/2023 Spaeth ..... F25B 41/20

FOREIGN PATENT DOCUMENTS

EP 3663680 A1 6/2020
WO 2014048482 A1 4/2014
WO WO-2020176780 A1 * 9/2020 ..... F25B 39/00

OTHER PUBLICATIONS

European Search Report for Application No. 20212051.5, dated May 5, 2021; 8 Pages.

* cited by examiner

CONDENSERS FOR HEATING AND/OR COOLING SYSTEMS

FOREIGN PRIORITY

This application claims priority to European Patent Application No. 20212051.5, filed Dec. 4, 2020, and all the benefits accruing therefrom under 35 U.S.C. § 119, the contents of which in its entirety are herein incorporated by reference.

TECHNICAL FIELD

The present disclosure relates to condensers for heating and/or cooling systems and, in particular, to condensers that allow for heat exchange between refrigerant at different stages of a refrigeration cycle to sub-cool refrigerant within the condenser.

BACKGROUND

It is common for heating and/or cooling systems to contain a heat exchanging device (an "economiser") for sub-cooling refrigerant (cooling refrigerant in a liquid phase below the boiling point) between the refrigerant leaving a condenser and reaching an evaporator. This reduces the temperature of the refrigerant to increase the cooling capacity of the refrigerant that subsequently undergoes evaporation in the evaporator. This can increase the amount of heat absorbed by the refrigerant in the evaporator, which may also increase the amount of heat expelled from the refrigerant in the condenser. This can also ensure that the refrigerant remains in a liquid phase until it is desired for the refrigerant to undergo a phase change to a vapour phase at an expansion valve.

Brazed plate heat exchanging devices, for example, may allow for suitably efficient heat exchange to cool refrigerant flowing through the heat exchanging device. However, the addition of an external heat exchanging device increases the cost and space requirements of the cooling system. Furthermore, brazed plate heat exchanging devices can result in a pressure drop of liquid refrigerant.

Refrigerant within a condenser is typically cooled by a separate fluid (e.g. water or brine (e.g. ethylene glycol or propylene glycol)) absorbing heat from the refrigerant. The fluid is at a lower temperature than gas phase refrigerant entering the condenser. Heat exchange from the refrigerant to the fluid occurs while the fluid passes through condensing conduits that are in thermal communication with the refrigerant. This results in the refrigerant condensing into a liquid phase. Although sub-cooling of liquid phase refrigerant may also be achieved by heat exchange from the liquid phase refrigerant to the fluid in the condensing conduits, the extent of sub-cooling that can be achieved is typically low because there may be a temperature difference of only a few degrees Celsius between the refrigerant and the fluid in the condensing conduits.

SUMMARY

A first aspect of the present disclosure provides a method of cooling a refrigerant, comprising: providing a condenser comprising a condenser shell that contains a condenser chamber, a condensing conduit, and a cooling conduit; condensing a refrigerant within the condenser chamber from a vapour phase to a liquid phase by exchanging heat from the refrigerant in the condenser chamber to a fluid in the condensing conduit; supplying a first portion of the condensed refrigerant to the cooling conduit via a first expansion valve such that the first portion of the refrigerant decreases in pressure and temperature before entering the cooling conduit; and cooling the refrigerant in the condenser chamber by exchanging heat from the refrigerant in the condenser chamber to the first portion of the refrigerant in the cooling conduit.

The method is suitable for use with heating systems, cooling systems or heating and cooling systems. The inventor has recognised that by providing a condenser with a cooling conduit for receiving a first portion of condensed refrigerant from the condenser chamber, condensed refrigerant within the condenser chamber may be sub-cooled by supplying the first portion of the refrigerant to the condenser chamber at a lower temperature (and pressure) than the condensed refrigerant within the condenser chamber. Supplying the first portion of the refrigerant to the cooling conduit via the first expansion valve results in the first portion of the refrigerant decreasing in pressure and temperature before entering the cooling conduit, such that the sub-cooling may occur as a result of the temperature difference between the first portion of the refrigerant in the cooling conduit and condensed refrigerant in the condenser chamber (that is external to the cooling conduit).

The inventor has also recognised that by providing a condenser with a cooling conduit as discussed above, the size and cost requirements of the system may be reduced compared to, for example, instead providing an external heat exchanging device. Providing such a system can also avoid a potential pressure drop occurring (e.g. in an external heat exchanging device). In addition, providing for additional cooling within the condenser can increase the rate at which the refrigerant is condensed within the condenser, so that a larger volume of condensed refrigerant can be maintained within the condenser. This can ensure that condensed refrigerant may exit the condenser at a suitable rate and pressure.

Although the condensing conduit is suitable for condensing the refrigerant within the condenser chamber, the cooling conduit may be more suitable for sub-cooling condensed refrigerant within the condenser chamber than the condensing conduit is or would be. This is because there may be a larger temperature difference between the first portion of the refrigerant and the condensed refrigerant in the condenser chamber compared to a temperature difference between fluid in the condensing conduit and the condensed refrigerant in the condenser chamber.

The method may comprise supplying a second portion of the refrigerant from the condenser chamber to a compressor, wherein the second portion of the refrigerant bypasses the cooling conduit and optionally also bypasses the first expansion valve.

Both the first portion of the refrigerant and the second portion of the refrigerant may be retained within the heating and/or cooling system. The first and second portions of the refrigerant may pass through any other components of the system, as appropriate. However, by bypassing the cooling conduit, the second portion of the refrigerant does not pass through the cooling conduit. It will be appreciated that the first and second portions of the refrigerant may, however, be remixed after the first portion of the refrigerant has passed through the cooling conduit and the refrigerant may then be subsequently separated into different first and second portions in another cycle of the system.

The method may comprise supplying the first portion of the refrigerant from the cooling conduit to the compressor;

and supplying the first portion of the refrigerant and the second portion of the refrigerant from the compressor to the condenser chamber.

The condenser chamber may have a single inlet for receiving refrigerant or may have plural inlets for receiving refrigerant. The condenser chamber may have a single outlet for exiting refrigerant or may have plural outlets for exiting refrigerant.

Said step of supplying the second portion of the refrigerant to the compressor may comprise supplying the second portion of the refrigerant from the condenser chamber to an evaporator via a second expansion valve, and then supplying the second portion of the refrigerant from the evaporator to the compressor; optionally, the first portion of the refrigerant bypasses the second expansion valve, and/or the second portion of the refrigerant bypasses the first expansion valve.

The second expansion valve may expand the second portion of the refrigerant such that it may undergo evaporation within the evaporator to cool the desired target (e.g. to cool water in a water cooling system).

The first and second portions of the refrigerant may be remixed at any suitable positon within the system. For instance, this may be before or after the second portion of the refrigerant has passed through the evaporator. The first portion of the refrigerant may therefore be supplied from the cooling conduit to the compressor either directly or indirectly (i.e. with or without first passing through other components).

The first portion of the refrigerant may be supplied from the cooling conduit to the compressor whilst bypassing the evaporator; or the first portion of the refrigerant may be supplied from the cooling conduit to the compressor via the evaporator.

Depending on operational parameters such as the temperature of the target to be cooled within the evaporator, supplying the first portion of refrigerant to the compressor via the evaporator may provide for additional cooling capacity of the total refrigerant passing through the evaporator. Remixing the first and second portions of the refrigerant before they enter the compressor also allows for compressors to be used having a single inlet and may reduce the flow rate required to be maintained by the second expansion valve.

However, the first portion of the refrigerant may be supplied to the compressor via a first inlet of the compressor and the second portion of the refrigerant may be supplied to the compressor via a second inlet of the compressor. In this case, the first portion of the refrigerant may be supplied directly from the cooling conduit to the first inlet of the compressor (i.e. the first portion of the refrigerant bypasses the evaporator). Providing different inlets (i.e. different ports) on the compressor for receiving the first and second portions of refrigerant allows for the first and second portions of the refrigerant to be supplied to the compressor at different pressures and/or temperatures. This can increase the efficiency of the compressor. For example, the first portion of the refrigerant may be supplied to the compressor at a higher pressure than the second portion of the refrigerant, and may be mixed with the second portion of the refrigerant at an intermediate stage of its compression (e.g. once the second portion of the refrigerant has been compressed such that the first and second portions are at substantially the same pressure).

Another advantage of the cooling conduit is that it helps to ensure that the condensed refrigerant is supplied out of the condenser in a liquid phase. This ensures correct operation of the first and second expansion valves. However, the first portion of the refrigerant may undergo a phase transition in between the first expansion valve and the compressor. This may be an endothermic phase transition that increases the amount of heat that is exchanged from the condensed refrigerant in the condenser chamber to the first portion of the refrigerant in the cooling conduit. The phase transition may begin before the first portion of the refrigerant enters the cooling conduit. As the cooling conduit may be maintained at a lower pressure than a pressure inside the condenser chamber, the first portion of the refrigerant may undergo a phase transition inside the cooling conduit without the refrigerant in the condenser chamber undergoing the same phase transition, even if the first portion of the refrigerant reaches substantially the same temperature as the refrigerant inside the condenser chamber.

The first portion of the refrigerant may be supplied to the first expansion valve in a liquid phase and may be supplied from the first expansion valve to the cooling conduit solely in a liquid phase or as a mixture of a liquid phase and a vapour phase.

The method may comprise vaporising the first portion of the refrigerant within the cooling conduit.

From another aspect, the present disclosure provides a system, comprising: a condenser comprising a condenser shell that contains a condenser chamber, a condensing conduit, and a cooling conduit, wherein the condenser is configured to condense a refrigerant within the condenser chamber from a vapour phase to a liquid phase by exchanging heat from the refrigerant in the condenser chamber to a fluid in the condensing conduit; and a first expansion valve arranged between an outlet of the condenser chamber and the cooling conduit, the system being configured such that in use a first portion of the condensed refrigerant is supplied from the outlet of the condenser chamber to the cooling conduit via the first expansion valve such that the first portion of the refrigerant decreases in pressure and temperature before entering the cooling conduit; wherein the condenser is configured for refrigerant in the condenser chamber to be cooled by exchanging heat from the refrigerant in the condenser chamber to the first portion of the refrigerant in the cooling conduit.

The system may be a heating system, a cooling system, or a heating and cooling system. In an embodiment, the system is a water cooling system that is used to cool water by the refrigerant absorbing heat from the water (e.g. when the refrigerant is evaporated in an evaporator). The system may additionally or alternatively be a water heating system that is used to heat water by the refrigerant expelling heat to the water (e.g. when the refrigerant is condensed in the condenser).

The system may be configured to perform any of the method steps discussed herein.

The system may comprise a compressor configured to receive a second portion of the refrigerant from the condenser chamber, wherein the system is configured for the second portion of the refrigerant to bypass the cooling conduit.

The system may comprise an evaporator and a second expansion valve, wherein the system is configured for: the second portion of the refrigerant to be supplied from the condenser chamber to the evaporator via the second expansion valve, whilst bypassing the first expansion valve; the second portion of the refrigerant to be supplied from the evaporator to the compressor; and the first portion of the refrigerant to bypass the second expansion valve.

The compressor may comprise a first inlet for receiving the first portion of the refrigerant and a second inlet for receiving the second portion of the refrigerant.

The amount of refrigerant in the first portion relative to the second portion may be varied while the system is in use (e.g. for different cycles of the refrigerant around the system). This allows for the amount of refrigerant in the first portion to be optimised according to varying operational parameters, such as a change of temperature in the evaporator and/or a change of temperature of the fluid in the condensing conduit.

The amount of refrigerant in the first and second portions can be varied by varying the first and second expansion valves so as to alter the flow rates of refrigerant passing through them. For example, the temperature of the refrigerant may be sensed at one or more location in the system and fed back to a control system that has circuitry which controllably varies the first and/or second expansion value to control the flow rate therethrough (e.g. until the temperature sensor detects a target value). Alternatively, the first and/or second expansion valves may be configured to change the flow rate automatically based on their temperature (i.e. based on the refrigerant they receive). For example, thermostatic expansion valves (e.g. with sensing bulbs) may be used. The first and second expansion valves may operate independently or have a dependence on one another.

The system may be configured for the first expansion valve to vary the flow rate of the first portion of the refrigerant based on at least one of: one or more properties of condensed refrigerant supplied out of the condenser chamber; one or more properties of the first portion of the refrigerant supplied out of the cooling conduit; and one or more properties of refrigerant within the condenser chamber.

The one or more properties may comprise a temperature and/or a pressure. The one or more properties may comprise a property or properties that are measured (directly) and/or may comprise a property or properties that are calculated.

The one or more properties may provide an indication of the extent of sub-cooling within the condenser chamber. For instance, the first expansion valve may vary the flow rate of the first portion of the refrigerant based on a temperature of condensed refrigerant supplied out of the condenser chamber. By sensing the temperature of condensed refrigerant supplied out of the condenser (i.e. between the refrigerant exiting the condenser and reaching the first and/or second expansion valves), the amount of refrigerant in the first portion of the refrigerant can be increased when additional sub-cooling of the refrigerant is desired. Additionally or alternatively, sensing the temperature of the first portion of the refrigerant supplied out of the cooling conduit (i.e. between the first portion of the refrigerant exiting the cooling conduit and reaching the compressor) can provide a measure of the amount of heat that has been absorbed by the first portion of the refrigerant. This provides an indirect indication of the temperature of refrigerant within the condenser chamber.

The system may be configured for the first expansion valve to vary the flow rate of the first portion of the refrigerant based on a comparison of properties. For instance, a control system may calculate a saturation temperature (condensing temperature) for refrigerant being condensed within the condenser chamber (e.g. based on a measured pressure within the condenser chamber). The control system may compare the calculated saturation temperature to a temperature of condensed refrigerant being supplied out of the condenser chamber e.g. by calculating a difference. This can provide an indication of the extent of sub-cooling within the condenser chamber. The first expansion valve may vary the flow rate of the first portion of the refrigerant based on the comparison (i.e. based on the indication of the extent of sub-cooling).

Any other suitable comparison and/or measurement may be performed to provide an indication of the extent of sub-cooling within the condenser chamber.

The first expansion valve may control the amount of refrigerant in the first portion of the refrigerant based on a temperature difference between the temperature of condensed refrigerant supplied out of the condenser chamber and the temperature of the first portion of the refrigerant supplied out of the cooling conduit. For instance, the first expansion valve may control the rate of refrigerant passing therethrough based on a difference in temperature between the refrigerant being supplied to the first expansion valve and the temperature of refrigerant being supplied from the cooling conduit to the compressor.

From another aspect, the present disclosure provides a condenser comprising: a condenser shell that contains a condenser chamber and a condensing conduit, wherein the condensing conduit is configured for a refrigerant within the condenser chamber to be condensed from a vapour phase to a liquid phase by exchanging heat to a fluid in the condensing conduit; wherein the condenser shell further contains a cooling conduit for receiving a portion of the condensed refrigerant from the condenser chamber.

By providing a condenser with a cooling conduit as described above, condensing and sub-cooling of the refrigerant may be achieved more efficiently within the condenser compared to relying only on the condensing conduit. For instance, the cooling conduit may receive refrigerant at a lower temperature than the temperature of fluid received by the condensing conduit. Refrigerant in the cooling conduit may also undergo a phase transition to increase the amount of heat that can be absorbed (whereas the fluid in the condensing conduit may not).

The method and system described above may comprise a condenser having any of the optional features discussed herein.

The condenser may be configured for the cooling conduit to be submerged by liquid phase refrigerant when the condenser is in use. In other words, the cooling conduit may be arranged in the bottom of the condenser shell.

The condenser chamber may comprise a partitioning wall that divides the condenser chamber into first and second regions, wherein the condensing conduit is in the first region and the cooling conduit is in the second region, and wherein the partitioning wall comprises an orifice to allow refrigerant to flow from the first region to the second region.

Providing a partitioning wall as discussed above can ensure that condensed refrigerant does not flow out of the condenser chamber without being cooled by the cooling conduit. The partitioning wall may be used to define a sump in which liquid phase refrigerant is stored prior to exiting the condenser chamber. Maintaining liquid phase refrigerant in a sump within the condenser can allow the refrigerant to exit the condenser at relatively high rates and pressures.

Providing the condensing conduit and cooling conduit on different sides of the partitioning wall (i.e. in the first and second regions) may reduce or avoid heat being exchanged from fluid in the condensing conduit to condensed refrigerant that has been cooled by the cooling conduit (i.e. sub-cooled below the temperature at which the refrigerant has been condensed). For example, the partitioning wall may prevent refrigerant from coming into contact with the condenser conduit in between the refrigerant passing through the orifice of the partitioning wall and exiting the condenser chamber. This may improve the efficiency of the sub-cooling. For instance, after the condensed refrigerant has been cooled by the cooling conduit, the condensed refrigerant may be at a lower temperature than fluid in the condensing conduit. Avoiding or reducing subsequent heat exchange from the fluid in the condensing conduit to the condensed and cooled refrigerant may therefore ensure that the condensed refrigerant is maintained at a low temperature.

BRIEF DESCRIPTION OF THE DRAWINGS

Various embodiments will now be described, by way of example only, and with reference to the accompanying drawings in which.

DETAILED DESCRIPTION

Figure 1:
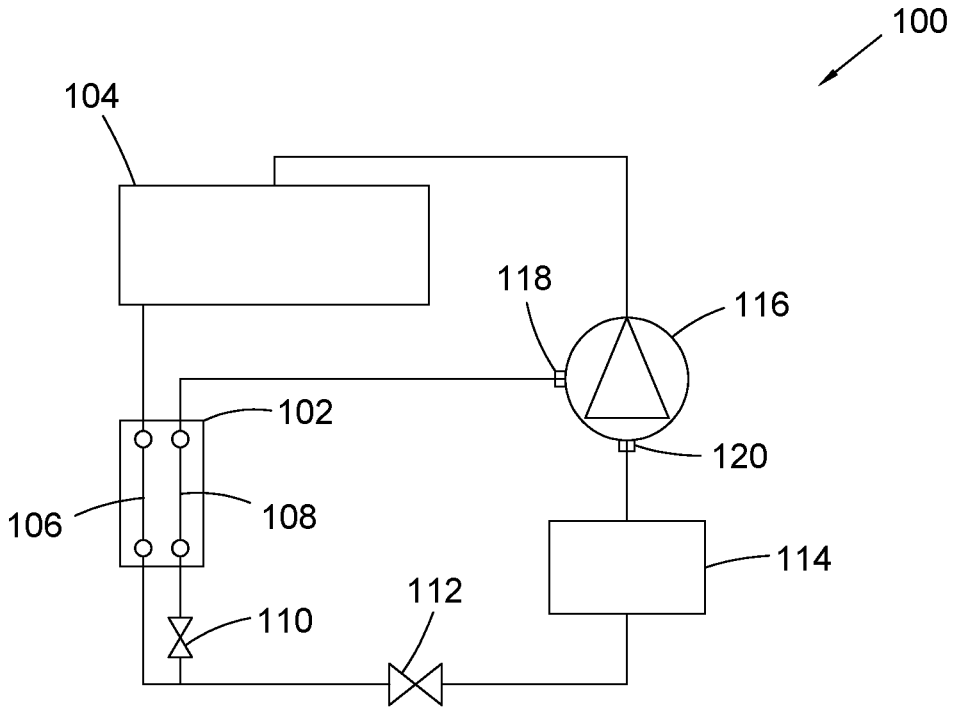
FIG. 1 shows a schematic of a cooling system with conventional heat exchanging apparatus.

FIG. 1 shows a schematic of a conventional cooling system 100 for cooling a refrigerant, where the refrigerant is used to cool a target fluid (not shown). The system 100 comprises a conventional heat exchanging device 102 that is external to a condenser 104 of the cooling system 100. In the cooling system 100, refrigerant absorbs heat from a target fluid to be cooled when the refrigerant undergoes evaporation within an evaporator 114 of the cooling system 100. The target fluid may be any suitable fluid such as water or a brine (e.g. in the case of a water or liquid cooling system) or may be air (e.g. in the case of an air cooling system). The evaporated refrigerant is sucked out of the evaporator 114 by a compressor 116 and is supplied to the condenser 104 to be condensed so that the above-described cycle can be repeated.

Refrigerant that has been condensed into a liquid phase within the condenser 104 is supplied to the evaporator 114 via a first conduit 106 of the heat exchanging device 102. The heat exchanging device 102 is used to cool the refrigerant passing through first conduit 106 and thereby increase the cooling capacity of the refrigerant when it subsequently undergoes evaporation within the evaporator 114.

To cool refrigerant within the heat exchanging device 102, a first portion of the refrigerant is supplied out of the first conduit 106 of the heat exchanging device 102 to a second conduit 108 of the heat exchanging device 102 via a first expansion valve 110. Supplying the first portion of the refrigerant via the first expansion valve 110 results in a decrease in the pressure and temperature of the first portion of the refrigerant when supplied to the second conduit 108 of the heat exchanging device 102. The decrease in temperature results from expansion (i.e. a pressure decrease) at the first expansion valve 110.

Within the heat exchanging device 102, heat is exchanged from refrigerant in the first conduit 106 to refrigerant in the second conduit 108 to cool the refrigerant in the first conduit 106. The amount of heat absorbed by the first portion of the refrigerant in second conduit 108 (i.e. the extent to which the refrigerant in the first conduit 106 is cooled) can be increased by the first portion of the refrigerant undergoing an endothermic phase transition. Typically, the first portion of the refrigerant is in a liquid phase when supplied to the first expansion valve 110 but is in two phases (a liquid phase and a vapour phase) when supplied to the second conduit 108 of the heat exchanging device 102. A phase change of some of the first portion of the refrigerant from a liquid phase to a vapour phase can reduce the temperature of the refrigerant prior to it being supplied to the second conduit 108. This phase change of the first portion of the refrigerant may then continue as it absorbs heat within the heat exchanging device 102.

A second portion of the refrigerant is supplied from the first conduit 106 of the heat exchanging device 102 to the evaporator 114 via a second expansion valve 112. The second portion of the refrigerant bypasses (i.e. does not pass through) both the first expansion valve 110 and the second conduit 108. The second expansion valve 112 is used to expand the second portion of the refrigerant such that it may undergo evaporation within the evaporator 114 to cool the desired target (e.g. to cool water in a water cooling system). As the second portion of the refrigerant has been cooled within the heat exchanging device 102, the cooling capacity of the second portion of the refrigerant has been increased compared to if it had been supplied directly from the condenser 104 to the evaporator 114 via the second expansion valve 112 (i.e. compared to if it had not passed through the heat exchanging device 102).

The first and second portions of the refrigerant are both supplied to the compressor 116 for compression (pressure increase) before being supplied back to the condenser 104 to allow for the process to be repeated. In this example, the first portion of the refrigerant is supplied from the second conduit 108 to the compressor 116 via a first port 118 of the compressor 116 and the second portion of the refrigerant is supplied from the evaporator 114 to the compressor 116 via a second port 120 of the compressor 116.

The relative amount of refrigerant in the first and second portions can be varied to achieve optimal efficiency of the system.

The external heat exchanging device 102 can be used in the manner set out above to improve the efficiency of the cooling system 100 by increasing the cooling capacity of the refrigerant that is supplied to the evaporator 114 and reducing the power consumption of the compressor 116. However, the external heat exchanging device 102 introduces additional cost and space requirements to the cooling system 100. Furthermore, suitable cooling within the condenser 104 must still be achieved to ensure that refrigerant flows out of the condenser 104 to the external heat exchanging device 102 in a liquid phase.

Figure 2A:
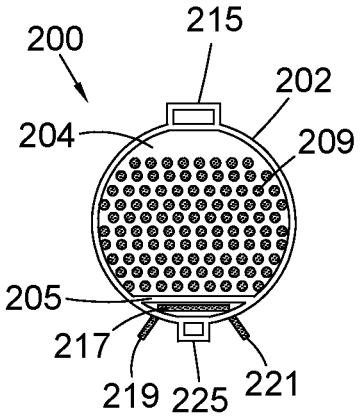
FIGS. 2A-C show views of a condenser that is in accordance with embodiments of the present disclosure.
Figure 2B:
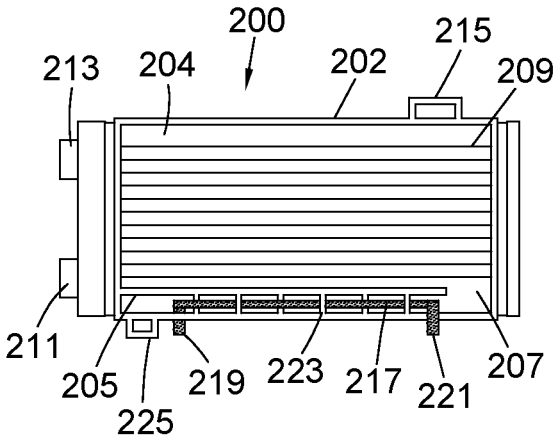
Figure 2C:
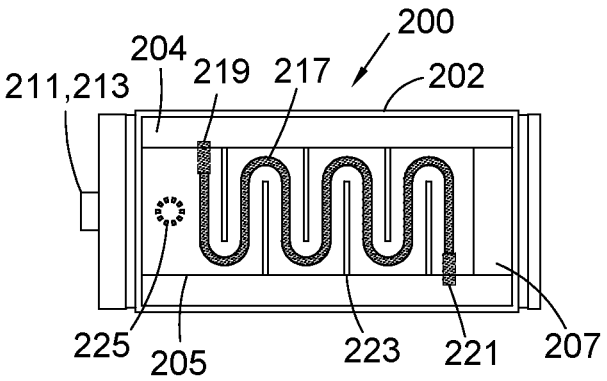

FIGS. 2A-C show views of a condenser 200 that is in accordance with an embodiment of the present disclosure. The condenser 200 comprises a condenser shell 202 (i.e. a housing) containing a condenser chamber 204. The condenser chamber 204 is partitioned into first and second regions by a partitioning wall 205 that contains an orifice 207 for allowing fluid communication between the first and second regions.

The condenser 200 comprises a condensing conduit 209 that extends within the first region of the condenser chamber 204 for a fluid (e.g. water) to flow through from an inlet 211 of the condensing conduit 209 to an outlet 213 of the condensing conduit 209. The condensing conduit 209 takes a winding path through the first region of the condenser chamber 204 to fill a substantial portion of the region while allowing for refrigerant to flow between the sections of the condensing conduit. Alternatively, multiple separate condensing conduits may pass through the chamber 204 for cooling the refrigerant.

The condenser chamber 204 has an inlet 215 for receiving refrigerant in a gas phase (e.g. a vapour phase) and an outlet 225 for exiting refrigerant in a liquid phase. The inlet 215 of the condenser chamber 204 is positioned relative to the condensing conduit 209 to provide for heat exchange between fluid in the condensing conduit 209 and refrigerant in a gas phase within the first region of the condenser chamber 204. The condenser 200 is thereby configured for fluid flowing within the condensing conduit 209 to cool refrigerant entering the condenser chamber 204 (via the inlet 215) in a gas phase to condense refrigerant within the condenser chamber 204 into a liquid phase. Although shown with a single inlet 215 and a single outlet 225, the condenser chamber may have a plurality of inlets 215 and/or a plurality of outlets 225.

Liquid phase refrigerant that has been condensed in the first region may flow into the second region via the orifice 207 in the partitioning wall 205. The condenser 200 further comprises a cooling conduit 217 in the form of a tube that extends within the second region of the condenser chamber 204. The tube 217 has an inlet 219 and an outlet 221 that are separate from the inlet 215 and outlet 225 of the condenser chamber 204. The tube 217 is positioned within the second region of the condenser chamber 204 such that the condenser 200 is configured for the tube 217 to be submerged in refrigerant that has been condensed into a liquid phase within the condenser chamber 204.

The second region of the condenser chamber 204 comprises baffles 223 configured to define a path for refrigerant to flow from the orifice 207 in the partitioning wall 205 to the outlet 225 of the condenser chamber 204. The tube 217 extends within the second region of the condenser chamber 204 such that refrigerant flowing from the orifice 207 in the partitioning wall 205 to the outlet 225 of the condenser chamber 204 along a path defined by the baffles 223 will flow proximate to substantially all of the length of the tube 217 within the condenser shell 202. The condenser 200 is thereby configured for heat exchange to occur within the condenser shell 202 between refrigerant in a liquid phase in the condenser chamber 204 and refrigerant in the tube 217.

Although the features of the condenser 200 are described above as including the partitioning wall 205 and baffles 223 to define a path for the refrigerant to undergo suitable heat exchange within the condenser shell 202, the condenser 200 may be configured in any additional or alternative manner suitable for refrigerant to be condensed from a gas phase (e.g. vapour phase) to a liquid phase within the condenser chamber 204 and for heat exchange to occur between refrigerant in the condenser chamber 204 (e.g. once in a liquid phase) and refrigerant in the cooling conduit 217.

Any number of partitioning wall(s) 205, baffle(s) 223 and region(s) may be provided within the condenser chamber 204 while maintaining a path for refrigerant to flow from the inlet 215 of the condenser chamber 204 to the outlet 225 of the condenser chamber 204. The partitioning wall 205 and/or the baffles 223 may be omitted. The partitioning wall(s) 205 and baffle(s) 223 may each contain a single or a plurality of orifices. A suitable path (e.g. straight path, zig-zag path, serpentine path, chicane path, spiral path, helical path) may be provided in one or more regions of the condenser chamber 204, such as in one or more regions within which the cooling conduit 217 extends. The cooling conduit 217, or a portion thereof, may have any suitable size and shape (e.g. tube shaped, coil shaped, plate shaped, straight, serpentine, zig-zag, spiral shaped, helical shaped) suitable for being immersed in, and/or exchange heat with, a liquid phase refrigerant in the condenser chamber 204. Different portions of the cooling conduit 217 may have different shapes.

The cooling conduit 217 may have a shape corresponding to the shape of the path defined for the flow of refrigerant in the condenser chamber 204. The path defined for refrigerant being cooled in the second region may be concentric with the cooling conduit 217. In an embodiment, the baffles 223 are arranged in an interdigitated pattern. In this embodiment, the cooling conduit 217 may extend in a curved shape through the interdigitated pattern.

The cooling conduit 217 may contain protrusions or fins to increase the surface area available for heat exchange. The cooling conduit 217 may be shaped to a curve of the condenser shell 202. Refrigerant may flow through the cooling conduit 217 in the same flow direction as the flow of refrigerant being cooled within the condenser chamber 204 or the cooling conduit 217 may have a counter flow relative to the flow of refrigerant being cooled in the condenser chamber 204.

A plurality of cooling conduits 217 (e.g. a plurality of tubes) may be provided that are each in accordance with the cooling conduit 217 as described above. A plurality of condensing conduits 209 may be provided that are each in accordance with the condensing conduit 209 described above. The plurality of cooling conduits 217 may be in fluid communication with one another within the condenser shell 202 or sealed from one another within the condenser shell 202. The plurality of cooling conduits 217 may each have the same or differing features from any of the optional features described above for the cooling conduit 217. The plurality of cooling conduits 217 may be arranged in series or in parallel relative to the flow of refrigerant within the condenser chamber 204. The plurality of cooling conduits 217 may be arranged to have parallel or counter flows relative to one another.

The one or more cooling conduits 217 may be connected to the condenser shell 202 and/or to one another in any suitable manner. For instance, the one or more cooling conduits 217 may have a soldered, brazed, flanged or other connection. In an embodiment, a plurality of cooling conduits 217 may be provided in a stack of brazed plates within the condenser shell 202.

Figure 3:
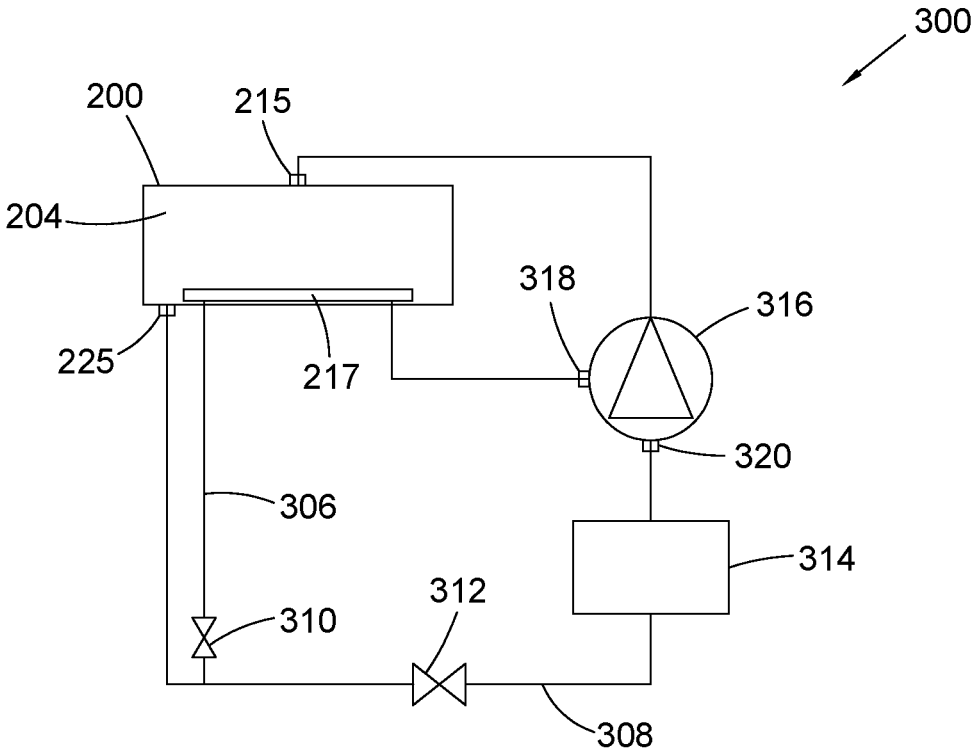
FIG. 3 shows a schematic of a cooling system that comprises the condenser of FIGS. 2A-C.

FIG. 3 shows a schematic of a cooling system 300 that comprises the condenser 200 of FIGS. 2A-C. The cooling system 300 is suitable for use with any condenser described herein comprising a cooling conduit 217 for receiving refrigerant. The cooling system 300 comprises a first expansion valve 310, second expansion valve 312, evaporator 314 and compressor 316 that may all be in accordance with the corresponding components of the cooling system 100 shown in FIG. 1. However, the cooling system 300 of FIG. 3 omits the external heat exchanging device 102 that the cooling system 100 of FIG. 1 comprises.

In the cooling system 300 of FIG. 3, a first portion of the refrigerant that has been condensed in the condenser 200 is supplied from the condenser chamber 204 to a first inlet 318 of the compressor 316 via a first path 306. A second portion of the refrigerant that has been condensed in the condenser 200 is supplied from the condenser chamber 204 to a second inlet 320 of the compressor via a second path 308. The first portion of the refrigerant is supplied from the outlet 225 of the condenser chamber to the cooling conduit 217 of the condenser 200 via the first expansion valve 310. Supplying the first portion of the refrigerant via the first expansion valve 310 results in a decrease in the pressure and temperature of the first portion of the refrigerant before it enters the cooling conduit 217. The decrease in temperature results from expansion (i.e. a pressure decrease) at the first expansion valve 310. The cooling conduit 217 cools refrigerant in the condenser chamber 204 (i.e. refrigerant in the condenser 200 external to the cooling conduit 217) by heat being exchanged from the refrigerant in the condenser chamber to the first portion of the refrigerant in the cooling conduit 217. The cooling conduit 217 may thereby be used to sub-cool refrigerant in a liquid phase within the condenser 200. This heat exchange is facilitated by the difference in temperature between refrigerant in the condenser chamber 204 and the first portion of the refrigerant in the cooling conduit 217. The amount of heat that can be absorbed by the first portion of the refrigerant can be increased by the first portion of the refrigerant undergoing an endothermic phase transition within the cooling conduit 217. In an embodiment, the first portion of the refrigerant is in a liquid phase when supplied to the first expansion valve 310 but is in two phases (a liquid phase and a vapour phase) when supplied to the cooling conduit 217. In this embodiment, a phase change of the first portion of the refrigerant from a liquid phase to a vapour phase may then continue as it absorbs heat within the cooling conduit 217.

After being used to cool the refrigerant in the condenser chamber 204, the first portion of the refrigerant is supplied out of the cooling conduit 217 and to the compressor 316. Substantially all of the first portion of the refrigerant may be in a gas or vapour phase when supplied from the cooling conduit 217 to the compressor 316.

With further reference to the embodiment of FIG. 3, the second portion of the refrigerant is supplied from the outlet 225 of the condenser chamber 204 to the evaporator 314 via the second expansion valve 312. The second portion of the refrigerant bypasses (i.e. does not pass through) both the first expansion valve 310 and the cooling conduit 217. The second expansion valve 312 is used to expand the second portion of the refrigerant such that it may undergo evaporation within the evaporator 314 to cool the desired target (e.g. to cool water in a water cooling system). The refrigerant may be supplied to the second expansion valve 312 in a liquid phase and may be supplied to the evaporator 314 in two phases (i.e. a liquid phase and a vapour phase). Cooling the refrigerant within the condenser chamber 204 using cooling conduit 217 increases the cooling capacity of the second portion of the refrigerant when it is supplied to the evaporator 314.

The second portion of the refrigerant is supplied to the compressor 316 from the evaporator 314 via second inlet 320. Within the compressor 316, both the first and second portions of refrigerant undergo compression (pressure increase) before being supplied back to the condenser chamber 204 via inlet 215 in a gas or vapour phase to allow for the process to be repeated. As referred to above, in the cooling system 300 of FIG. 3, the first portion of the refrigerant is supplied from the cooling conduit 217 to the compressor 116 via the first inlet 318 of the compressor 316 (i.e. a first compressor port) and the second portion of the refrigerant is supplied from the evaporator 314 to the compressor 316 via the second inlet 320 of the compressor 316 (i.e. a second compressor port). As the first and second portions of refrigerant are provided to the compressor 316 at different inlets, the first and second portions of the refrigerant may be supplied to the compressor 316 at different pressures and/or temperatures. This can allow the compressor 316 to operate more efficiently.

Figure 4:
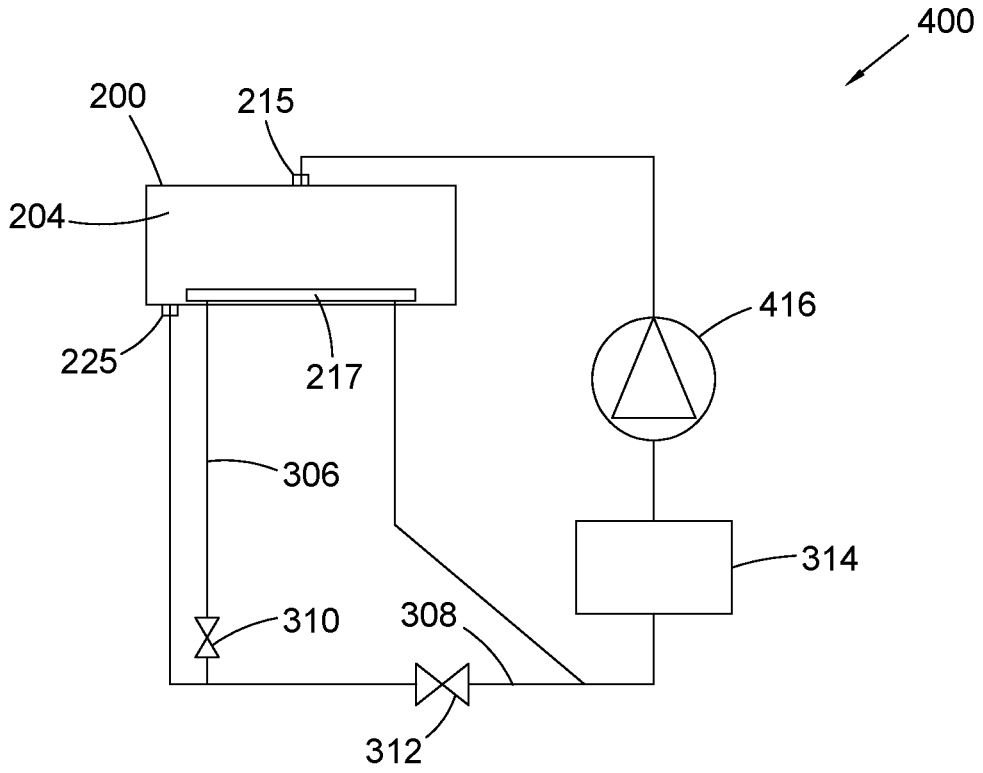
FIG. 4 shows a schematic of an alternative cooling system that comprises the condenser of FIGS. 2A-C.

FIG. 4 shows a schematic of an alternative cooling system 400 that comprises the condenser of FIGS. 2A-C. The cooling system 400 of FIG. 4 may be used with any condenser described herein that comprises a cooling conduit 217. Compared with the embodiment of FIG. 3, in the embodiment of FIG. 4, the compressor 416 has a single input for receiving both the first and second portions of the refrigerant.

With continued reference to the embodiment of FIG. 4, the first portion of the refrigerant may be intermixed with the second portion of the refrigerant after the second portion of the refrigerant has passed through the second expansion valve 312 but prior to the second portion of the refrigerant entering the evaporator 314. In this embodiment, the first portion of the refrigerant also passes through an evaporation chamber of the evaporator 314. In an alternative embodiment, the first portion of the refrigerant may be intermixed with the second portion of the refrigerant after the second portion of the refrigerant has passed through an evaporation chamber of the evaporator 314 (i.e. the first portion of the refrigerant bypasses the evaporation chamber). For example, the first and second portions may be intermixed after the second portion of the refrigerant has passed through a distributor of the evaporator but prior to either portion being supplied to the compressor 416.

Compared with the embodiment of FIG. 3, the embodiment of FIG. 4 does not require a compressor with multiple inputs. In addition, the first portion of the refrigerant may still provide additional cooling capacity if it passes through the evaporator 314. Remixing the first and second portions of the refrigerant before they enter the compressor 316 may also reduce the flow rate required to be maintained by the second expansion valve 312. However, in the embodiment of FIG. 3, the compressor 316 may operate more efficiently if it receives the first portion of the refrigerant at a higher pressure than it receives the second portion of the refrigerant. Depending on operational parameters, e.g. the temperature of the target to be cooled within the evaporator 314, it may also be more efficient for only the second portion of the refrigerant to be supplied to the evaporator 314.

The relative amount of refrigerant in the first and second portions can be varied to achieve optimal efficiency of the system.

In embodiments, the first and second expansion valves 310, 312 may be coupled to one or more sensors that are used to control the amount of refrigerant in the first and second portions. For example, the first expansion valve 310 may be a thermostatic expansion valve (or other flow varying valve) coupled to a sensing bulb (or other temperature sensor) that senses the temperature of the first portion of the refrigerant in between it leaving the cooling conduit 217 and entering the compressor 316. The first expansion valve 310 may increase the amount of refrigerant in the first portion in response to the temperature sensed by the sensing bulb increasing. This corresponds to a rise in temperature of condensed refrigerant within the condenser 200 and increasing the amount of refrigerant in the first portion can act to counteract this rise in temperature. The second expansion valve 312 be a thermostatic expansion valve (or other flow varying valve) coupled to a sensing bulb (or other temperature sensor) that senses the temperature of refrigerant in between leaving the evaporator 314 and entering the compressor 316. Alternatively, the first and/or second expansion valves may operate electronically. For example, an electronic controller may control the first and second expansion valves to vary the amount of the refrigerant in the first portion compared to the second portion. This may be based on one more temperatures communicated to the controller and/or other operational parameters.

As with the example of FIG. 1, the embodiments of FIGS. 3 and 4 can improve the efficiency of cooling systems by extracting a first portion of the refrigerant and using the extracted portion of the refrigerant to increase the cooling capacity of the second portion of the refrigerant that is supplied to the evaporator. However, compared to the example of FIG. 1, the embodiments of FIGS. 3 and 4 allow for a more compact cooling system with less external components. Removing the need for an external heat exchanging device and/or reducing the number or length of condensing conduit(s) required can reduce the amount of required structure/material (which can reduce costs). This can also avoid a pressure drop of the refrigerant in an external heat exchanging apparatus. Furthermore, the use of the cooling conduit 217 within the condenser 200 can reduce the number and/or length of condensing conduit(s) 209 required by the condenser 200 that would be required to otherwise ensure that suitable condensation and cooling occurs within the condenser 200. For instance, there may be a small temperature difference (e.g. 5° C. or less) between a fluid in the condensing conduit(s) 209 and refrigerant in the condenser chamber 204. However, there may be a larger temperature difference between refrigerant in the condenser chamber 204 and refrigerant in the cooling conduit 217.

Moreover, a condenser 200 in accordance with the present disclosure can also, when in use, maintain a larger volume of liquid refrigerant within the condenser 200 (such as in a condenser sump, e.g. the second region of the condenser chamber 204 in the embodiment of FIGS. 2A-C). This allows the cooling system to operate more efficiently across a wider range of operating conditions. In addition, cooling the refrigerant in the condenser chamber 204 via the cooling conduit 217 can reduce or negate the presence of any gas phase in the refrigerant that is supplied from the condenser chamber 204 to the expansion valves. This ensures correct operation of the expansion valves, as an expansion valve configured to receive a liquid phase fluid may fail to correctly regulate the flow of the fluid if some portion of the fluid is supplied to the expansion valve in a gas phase.

It will be appreciated that embodiments described herein allow a condenser to provide an optimised flow of liquid refrigerant. For example, sub-cooling the refrigerant within the condenser may allow the condenser to provide a flow of liquid refrigerant from the condenser at relatively low temperatures and relatively high flow rates. Embodiments also enable a relatively lower total mass of refrigerant to be used, as the refrigerant more efficiently passes through the condenser. This can also improve the efficiency of other components within the system.

Although the present disclosure has been described with reference to various embodiments, it will be understood by those skilled in the art that various changes in form and detail may be made without departing from the scope defined by the accompanying claims.

For example, although a number of cooling systems have been described, it will be appreciated that a condenser in accordance with the present disclosure may be used in a heating system or a heating and cooling system. In this regard, it will be appreciated that the fluid in the condensing conduit is heated by absorbing heat from refrigerant in the condenser. This may be exploited to perform desired heating of a target fluid at the condenser (i.e. where the fluid in the condensing conduit is a target fluid to be heated) in addition to, or as an alternative to, desired cooling of a target fluid at the evaporator. Advantages of the present disclosure discussed above in the context of cooling systems are also applicable to heating and/or cooling systems. For instance, increasing the amount of heat absorbed by the refrigerant within the evaporator may also increase the amount of heat expelled from the refrigerant within the condenser to heat a target fluid in the condensing conduit. A heating system or heating and cooling system may comprise any of the appropriate optional features discussed herein for cooling systems.

Although the cooling conduit is described as extending within the condenser chamber, it is contemplated that the cooling conduit may allow for heat exchange with refrigerant in the condenser chamber without extending therein. The external walls of the cooling conduit may form part of the walls of the condenser chamber and/or the condenser shell. The first and/or second expansion valves may be provided as component(s) of the condenser.

Although embodiments of the present disclosure refer to the omission of external heat exchanging devices, it will be appreciated that any suitable heat exchanging devices may be employed in combination with a condenser disclosed herein. However, a condenser disclosed herein may at least reduce the external heat exchanging requirements of a heating and/or cooling system.

What is claimed is:

1. A method of cooling a refrigerant, comprising:

providing a condenser comprising a condenser shell that contains a condenser chamber, a condensing conduit, and a cooling conduit;

condensing a refrigerant within the condenser chamber from a vapour phase to a liquid phase by exchanging heat from the refrigerant in the condenser chamber to a fluid in the condensing conduit;

supplying a first portion of the condensed refrigerant from an outlet of the condenser chamber to the cooling conduit via a first expansion valve such that the first portion of the refrigerant decreases in pressure and temperature before entering the cooling conduit; and cooling the refrigerant in the condenser chamber upstream from said outlet by exchanging heat from the refrigerant in the condenser chamber to the first portion of the refrigerant in the cooling conduit.

2. The method of claim 1, comprising:

supplying a second portion of the refrigerant from the condenser chamber to a compressor, wherein the second portion of the refrigerant bypasses the cooling conduit and optionally also bypasses the first expansion valve.

3. The method of claim 2, comprising:

supplying the first portion of the refrigerant from the cooling conduit to the compressor; and supplying the first portion of the refrigerant and the second portion of the refrigerant from the compressor to the condenser chamber.

4. The method of claim 2, wherein said step of supplying the second portion of the refrigerant to the compressor comprises supplying the second portion of the refrigerant from the condenser chamber to an evaporator via a second expansion valve, and then supplying the second portion of the refrigerant from the evaporator to the compressor;

optionally, the first portion of the refrigerant bypasses the second expansion valve, and/or the second portion of the refrigerant bypasses the first expansion valve.

5. The method of claim 4, wherein:

the first portion of the refrigerant is supplied from the cooling conduit to the compressor whilst bypassing the evaporator; or the first portion of the refrigerant is supplied from the cooling conduit to the compressor via the evaporator.

6. The method of claim 3, wherein:

the first portion of the refrigerant is supplied to the compressor via a first inlet of the compressor and the second portion of the refrigerant is supplied to the compressor via a second inlet of the compressor.

7. The method of claim 1, wherein the first portion of the refrigerant is supplied to the first expansion valve in a liquid phase and is supplied from the first expansion valve to the cooling conduit solely in a liquid phase or as a mixture of a liquid phase and a vapour phase.

8. The method of claim 1, comprising vaporising the first portion of the refrigerant within the cooling conduit.

9. A system, comprising:

a condenser comprising a condenser shell that contains a condenser chamber, a condensing conduit, and a cooling conduit, wherein the condenser is configured to condense a refrigerant within the condenser chamber from a vapour phase to a liquid phase by exchanging heat from the refrigerant in the condenser chamber to a fluid in the condensing conduit; and a first expansion valve arranged between an outlet of the condenser chamber and the cooling conduit, the system being configured such that in use a first portion of the condensed refrigerant is supplied from the outlet of the condenser chamber to the cooling conduit via the first expansion valve such that the first portion of the refrigerant decreases in pressure and temperature before entering the cooling conduit;

wherein the condenser is configured for refrigerant in the condenser chamber upstream from said outlet to be cooled by exchanging heat from the refrigerant in the condenser chamber to the first portion of the refrigerant in the cooling conduit.

10. The system of claim 9, comprising:

a compressor configured to receive a second portion of the refrigerant from the condenser chamber, wherein the system is configured for the second portion of the refrigerant to bypass the cooling conduit.

11. The system of claim 10, comprising an evaporator and a second expansion valve, wherein the system is configured for:

the second portion of the refrigerant to be supplied from the condenser chamber to the evaporator via the second expansion valve, whilst bypassing the first expansion valve;

the second portion of the refrigerant to be supplied from the evaporator to the compressor; and the first portion of the refrigerant to bypass the second expansion valve.

12. The system of claim 10, wherein the compressor comprises a first inlet for receiving the first portion of the refrigerant and a second inlet for receiving the second portion of the refrigerant.

13. The system of claim 9, wherein the system is configured for the first expansion valve to vary the flow rate of the first portion of the refrigerant based on at least one of:

one or more properties of condensed refrigerant supplied out of the condenser chamber;

one or more properties of the first portion of the refrigerant supplied out of the cooling conduit; and one or more properties of refrigerant within the condenser chamber.

14. A condenser comprising:

a condenser shell that contains a condenser chamber and a condensing conduit, wherein the condensing conduit is configured for a refrigerant within the condenser chamber to be condensed from a vapour phase to a liquid phase by exchanging heat to a fluid in the condensing conduit;

wherein the condenser shell further contains a cooling conduit for receiving a portion of the condensed refrigerant from an outlet of the condenser chamber, and wherein the condenser is configured for refrigerant in the condenser chamber upstream from said outlet to be cooled by exchanging heat from the refrigerant in the condenser chamber to the portion of the condensed refrigerant in the cooling conduit.

15. The condenser of claim 14, wherein the condenser chamber comprises a partitioning wall that divides the condenser chamber into first and second regions, wherein the condensing conduit is in the first region and the cooling conduit is in the second region, and wherein the partitioning wall comprises an orifice to allow refrigerant to flow from the first region to the second region.

* * * * *